US005218756A

United States Patent [19]

Zaleski

[11] Patent Number: 5,218,756

[45] Date of Patent: Jun. 15, 1993

[54] MODULAR PUNCH PRESS STATION

[75] Inventor: Mitchell J. Zaleski, Northbrook, Ill.

[73] Assignee: Pylon tool Corporation, Northbrook, Ill.

[21] Appl. No.: 856,355

[22] Filed: Mar. 23, 1992

[51] Int. Cl.[5] ..... B23Q 7/10

[52] U.S. Cl. ..... 29/818; 29/809; 29/243.54; 227/55

[58] Field of Search ..... 29/525.1, 525.2, 809, 29/818, 715, 243.53, 243.54; 227/55

[56] References Cited

U.S. PATENT DOCUMENTS

| | | | |
|---|---|---|---|
| 1,456,079 | 5/1923 | Stuebner | 29/525.2 |
| 1,944,360 | 1/1934 | Meyer | 29/818 X |
| 2,056,559 | 10/1936 | Berliner | 29/818 X |
| 2,985,900 | 5/1961 | Nouvelet | 28/818 X |
| 4,005,519 | 2/1977 | Di Maio et al. | 29/818 |
| 4,864,713 | 9/1989 | Roberts et al. | 29/525.2 X |
| 5,042,137 | 8/1991 | Speller | 29/575.2 |

FOREIGN PATENT DOCUMENTS

| | | | |
|---|---|---|---|
| 2803260 | 8/1979 | Fed. Rep. of Germany | 29/818 |
| 24134 | 9/1989 | Japan | 29/525.2 |

*Primary Examiner*—Timothy V. Eley
*Attorney, Agent, or Firm*—Hill, Steadman, Simpson

[57] ABSTRACT

A modular punch press station is provided for use with a punch press which has a vertically movable ram. The station is useful for inserting a rivet-like contact into an aperture in a carrier piece and it comprises a mounting plate for carrying components of the modular punch press station including a supply device such as a vibratory feeder. The mounting member also carries an insertion station which positions a single contact below the ram in a vertical orientation in the aperture in the carrier piece. Mechanism is provided for feeding the contacts from the supply device to the insertion station such that only a single contact is presented to the insertion station at a time. The punch press station also includes an anvil positioned in line below the ram and carried on the mounting member for engaging and supporting a lower end of the contact when the ram descends into engagement with a top end of the contact such that the contact will be deformed between the ram and the anvil while it is positioned in the aperture in the carrier piece to thereby fix the contact to the carrier piece.

20 Claims, 9 Drawing Sheets

MODULAR PUNCH PRESS STATION

BACKGROUND OF THE INVENTION

The present invention relates to punch press equipment and more particularly to a modular punch press station and its method of operation.

Punch press devices are well known and include a ram usually vertically movable toward and away from an anvil. In some cases the piece of metal being operated on by the punch press will be struck by a punch pin and deformed by the pin or, in other cases the metal will be perforated by the pin which travels through the metal into a die held by the anvil.

Usually each station in a punch press is capable of performing a single operation, that is the punching of a particular sized hole or the deforming of the metal within the punch press in a single particular way. Many punch presses have means, such as rotatable turrets for providing different tools at a particular punch station. Those punch tools can range from relatively simple tools such as a cooperating punch pin and die or can be complex tools, particularly if a complex operation, such as the insertion and the joining by deformation of two or more pieces of metal is to occur.

In the past, such complex tools have comprised a multitude of parts which must be assembled and disassembled for each time a new series of parts is being manufactured with the punch press. It would be an advantageous advance in the art if such complex tooling were provided which did not require the assembly and disassembly of a multitude of parts when a particular manufacturing operation is to be performed.

SUMMARY OF THE INVENTION

The present invention provides a modular station for use in a punch press, which modular station contains a number of individual components assembled together to provide a complex series of steps necessary in a punch press operation. By combining all of the components into a modular unit, the entire unit itself need only be inserted or removed from the punch press station in order to provide a complex operation. No longer is it needed required that a large number of components be assembled and disassembled each time the complex operation is to be performed.

In a particular embodiment of the invention, a modular station is provided for feeding, guiding and inserting a rivet-like electrical contact piece into a separate metal piece such that when the punch pin engages the contact, the contact will be deformed and held secure or staked to the separate metal piece.

This particular modular station provides a feeding mechanism, such as vibratory feeder which feeds the individual metal insert pieces one at a time to a guide, in single file fashion. The pieces move along the guide and are stopped at a shuttle. The shuttle is arranged to transversely move one insert piece at a time, the movement being dependent upon a downward movement of the ram of the punch press. A mechanical drive, in the form of cooperating ram surfaces, causes the shuttle to move transversely to the guide, thus carrying a single one of the insert pieces to a track. When individual piece arrives at the track, a motive force, which in the particular embodiment described is either an air jet or an angled track utilizing the force of gravity, causes the insertion piece to move along the track towards an insertion station.

The insertion station, in a bottom-up feed arrangement, comprises a pair of jaws which are biased together for receiving the insertion piece. The jaws will hold the piece in a stationary position. As the ram descends, a lifting pin is pushed upwardly, due to mechanical drive means in the form of cooperating cam surfaces engaged due to the descent of the ram. As the pin moves upwardly it causes the jaws of the insertion station to separate, allowing the insertion piece to be pushed upwardly where it will be received in an aperture in the metal piece to be joined. As the ram continues to move downwardly it will cause a punch pin to strike the top of the insertion piece to deform it to result in the permanent capturing or staking of the insertion piece onto the second metal piece. The second metal piece is then advanced to a next station and a new second piece moves into the receiving position above the insertion station.

The insertion station, in a top-down feed arrangement, comprises a slotted funnel-like member which receives the insertion pieces and directs them downwardly into the aperture in the metal piece which it is to be joined to. The funnel member has a central passage which is vertically aligned with the aperture in the metal piece and is also vertically aligned with the punch pin which is moved downwardly by the ram. As the ram descends, the punch pin is pushed downwardly through the funnel piece to engage the head of the insertion piece. The lower end of the shank of the insertion piece is pressed against an anvil member which is held stationary while a surrounding anvil carrier member moves downwardly to expose the anvil member. As the ram continues to descend with the punch pin and anvil member engaging the insertion piece, the insertion piece is compressed to deform it into a secured relationship with the metal piece. The metal piece is then advanced to a next station and a new piece or a new portion of the piece moves into the receiving position below the insertion station.

DESCRIPTION OF THE PREFERRED EMBODIMENTS

Although the present invention is being described in this application with respect to a particular embodiment, that is the insertion of a rivet-like contact piece into a separate metal piece, in a progressive die in a punch press, the invention is not limited to such an arrangement.

Two preferred embodiments of the invention are illustrated throughout the figures.

Figure 1:
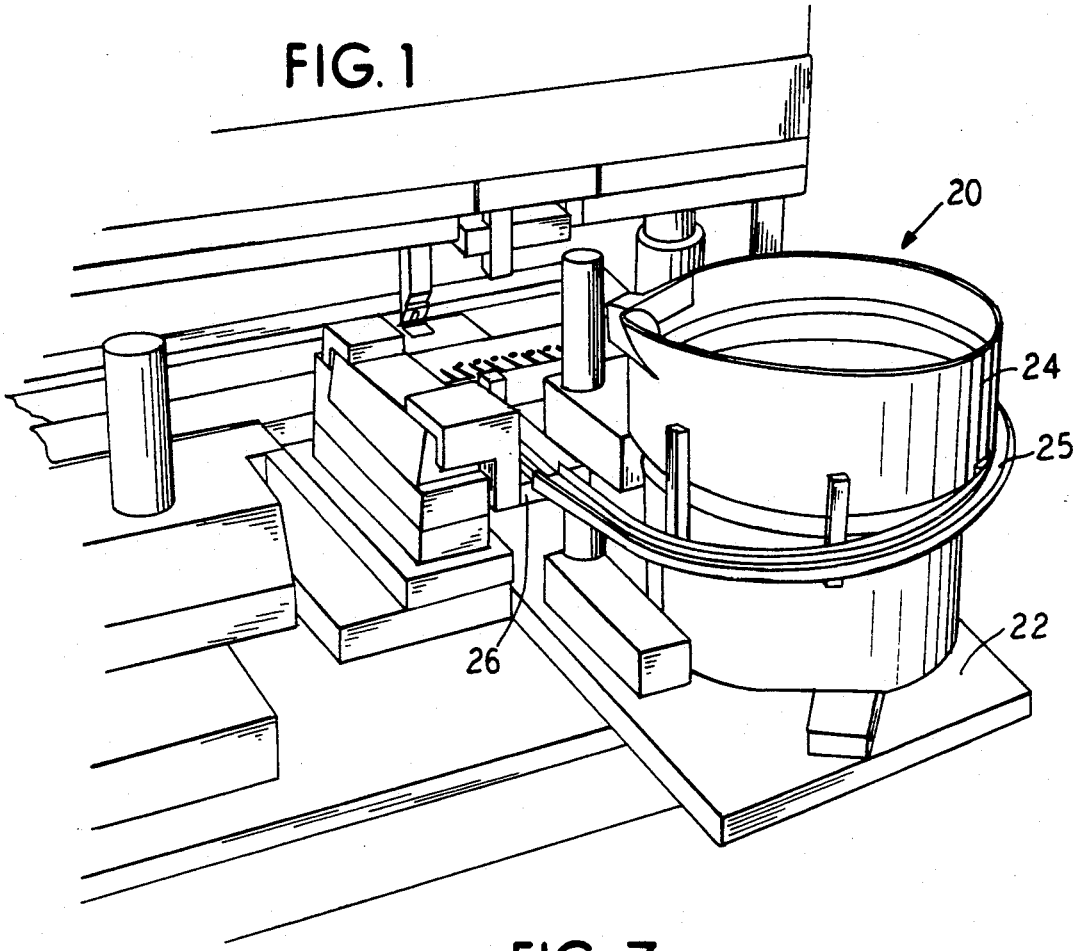
FIG. 1 is a perspective view of a modular contact feed installation station for use with a punch press.
Figure 7:
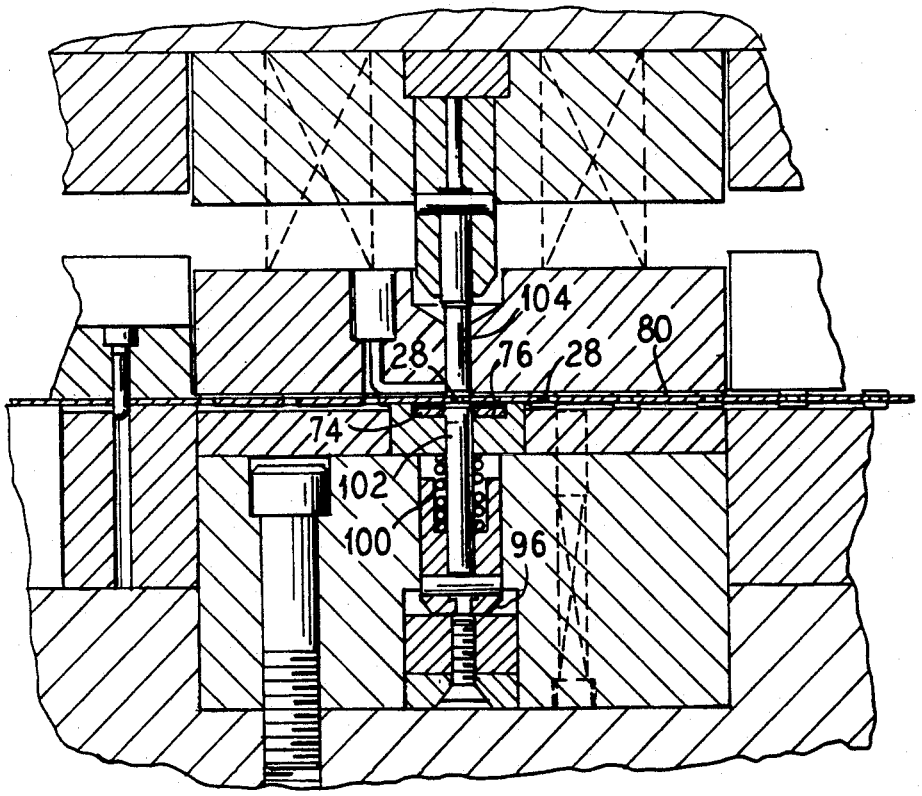
FIG. 7 is a sectional view taken generally along the lines VII—VII of FIG. 3 with the ram in a lowered position.
Figure 5:
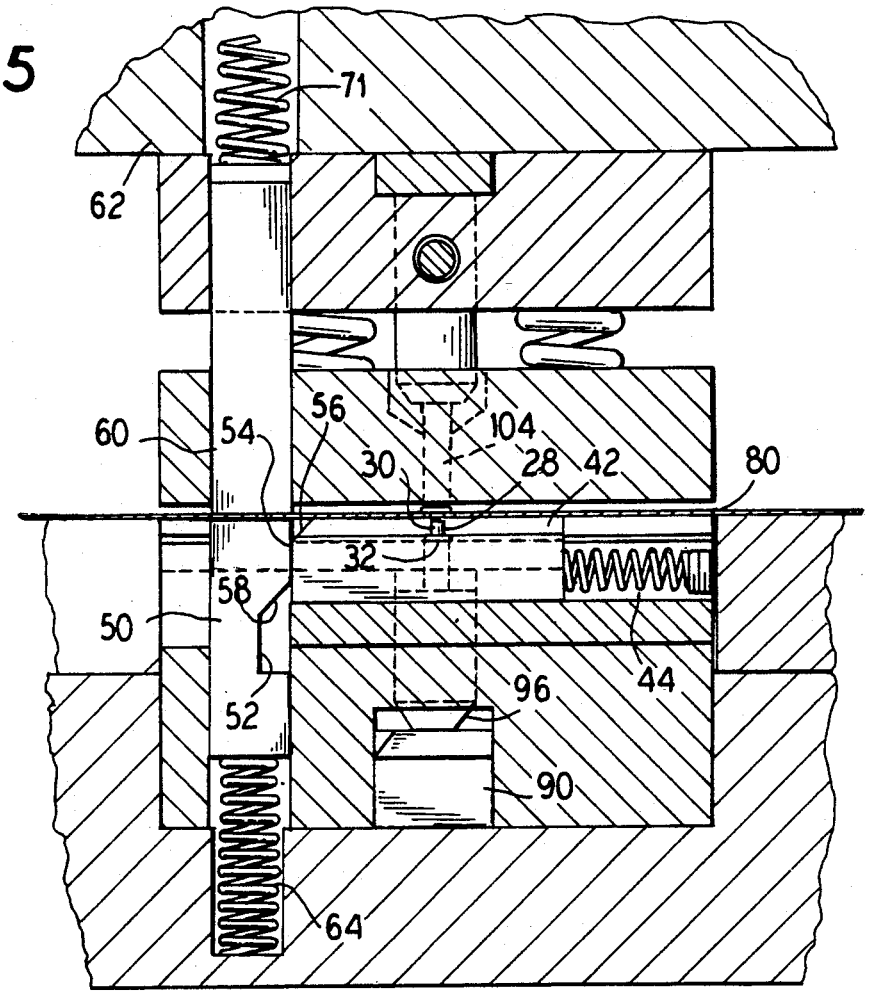
FIG. 5 is the section view like FIG. 4 but with the punch ram in the lowered position.
Figure 3:
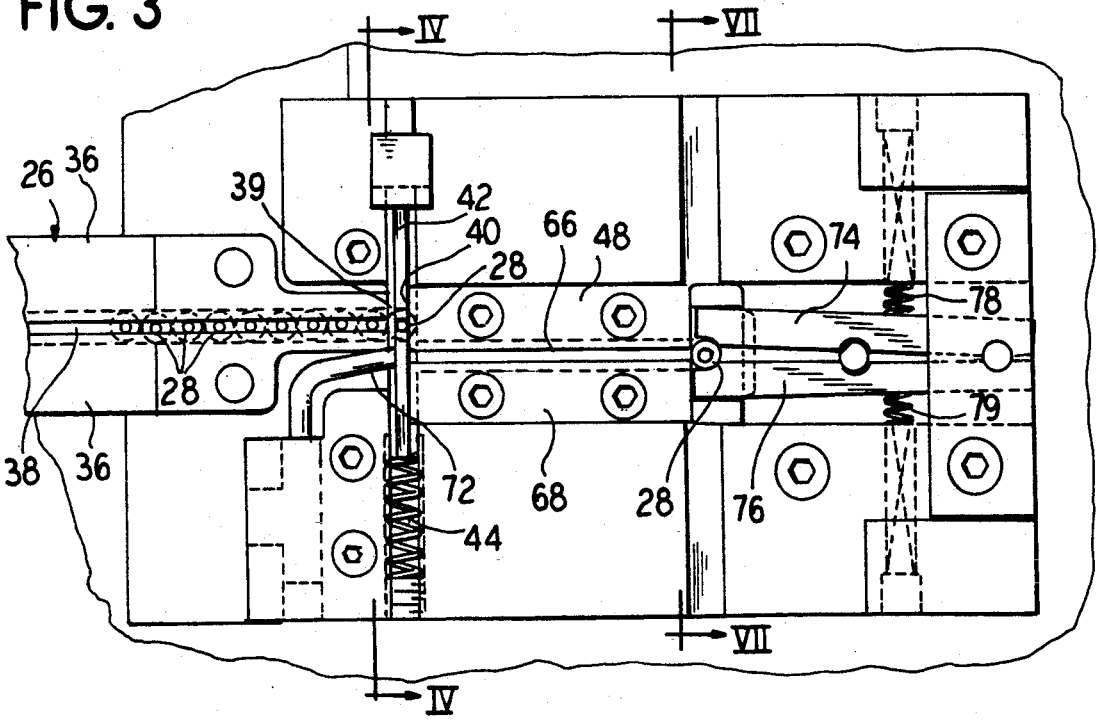
FIG. 3 is an enlarged plan view of the area identified by dash lines III of FIG. 2.

A first preferred embodiment is illustrated in FIGS. 1-7. In FIG. 1 there is a perspective view of a modular contact feed and installation station generally at 20 which is composed of a number of individual component parts mounted in a cooperating relationship. A mounting plate 22 is provided as a base member for receiving and supporting all of the various components. A feeding mechanism 24, which in this preferred embodiment is a vibratory feeder, is mounted to the mounting plate 22 to direct a series of insertion pieces from a reservoir area internal of the vibratory feeder along a ramped path 25. The path 25 carries the individual insertion pieces to a guide 26. In this particular embodiment, the insertion pieces are rivet-like contacts 28, the contact having a shaft portion 30 and an enlarged head portion 32 (FIG. 5). The guide 26 shown in FIG. 2 comprises a base member 34 (FIG. 6) upon which the insertion pieces slide in a head-down fashion, and a pair of guide plates 36 which are separated to provide a gap 38 therebetween which is slightly larger than a diameter of the shafts 30 of the contacts 28. Thus, the contacts will be permitted to slide along the base member 34 but will be held in a single file line by means of the guide plates 36, which also prevent the contacts from tipping over.

Figure 2:
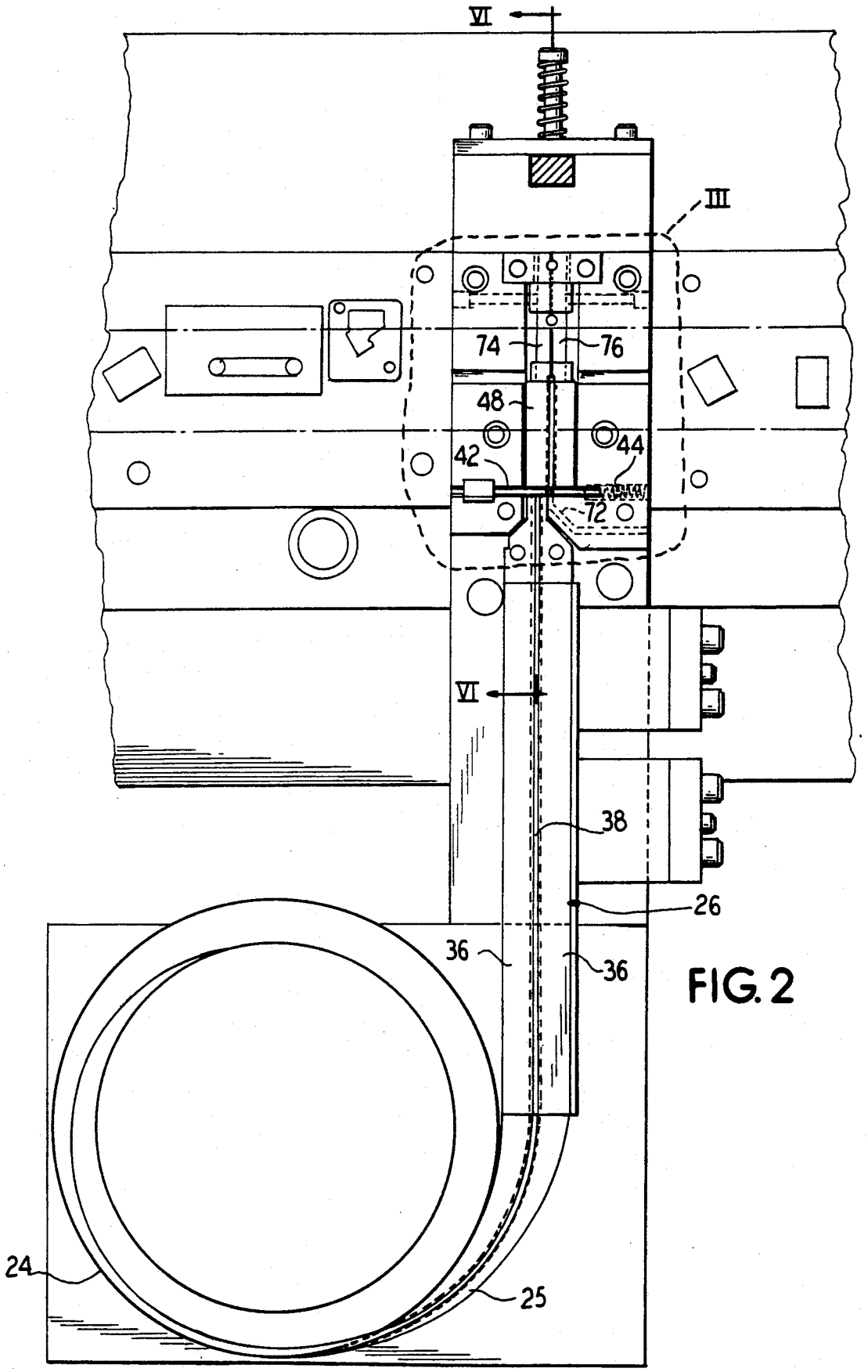
FIG. 2 is a plan view of the contact apparatus of FIG. 1.
Figure 4:
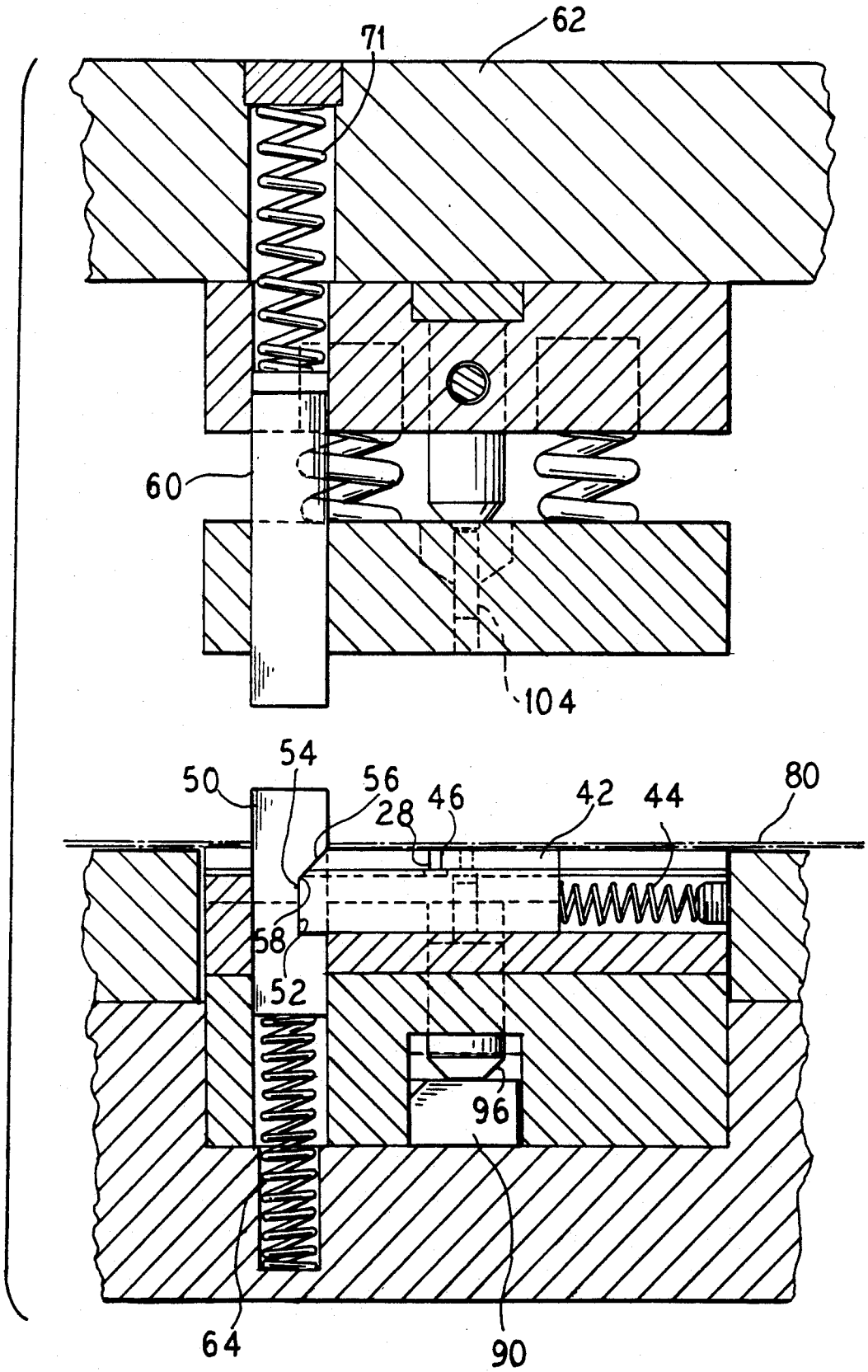
FIG. 4 is a section view taken generally along the line IV—IV of FIG. 3, with the punch press ram in the elevated position.

The guide 26 is angled slightly downwardly so that the insertion pieces will continue to move along the guide. At an end 39 (FIG. 3) of the guide 26 there is a transverse passage 40 and a block 42 is positioned in the transverse passage 40 and is biased by a spring 44 towards the left as seen in FIGS. 2 and 4 (up in FIG. 3). An aperture 46 is formed in the block 42 which is sized to receive a single insertion piece 28. Although the aperture 46 extends all the way through the block 42, a track plate 48 acts as a stop preventing further motion of the insertion device 28.

As best seen in FIGS. 4 and 5, the shuttle block 42 is engaged or received, at an end opposite the spring 44, in a post 50 which has a cut out or recess 52 dimensioned to receive an end 54 of the block 42. The end 54 has a ramp surface 56 which meets with a correspondingly shaped ramp surface 58 in the post 50.

A pin 60 is resiliently carried on a block 62 to be engaged by the ram. As the ram moves downwardly it pushes block 62 downwardly thus in turn causing pin 60 to move downwardly. When pin 60 engages post 50, as seen in FIG. 5, post 50 is pressed downwardly against the bias of spring 64 thus causing the shuttle block to move from the position of FIG. 4 to the position of FIG. 5, that is to the right, against a bias of spring 44. As this occurs, the first contact 28, which had been pressing against the end of track plate 48, is carried by block 42 and is positioned in alignment with a gap 66 (FIG. 3) between the track plate 48 and a second track plate 68. A solid base plate 70 (FIG. 6) supports the contacts 28 as they move along the gap 66. The pin 60 is supported in block 62 by a spring 71 (FIGS. 4 and 5) to prevent overloading or damage to the parts. Spring 71 is much stiffer than spring 64.

Figure 6:
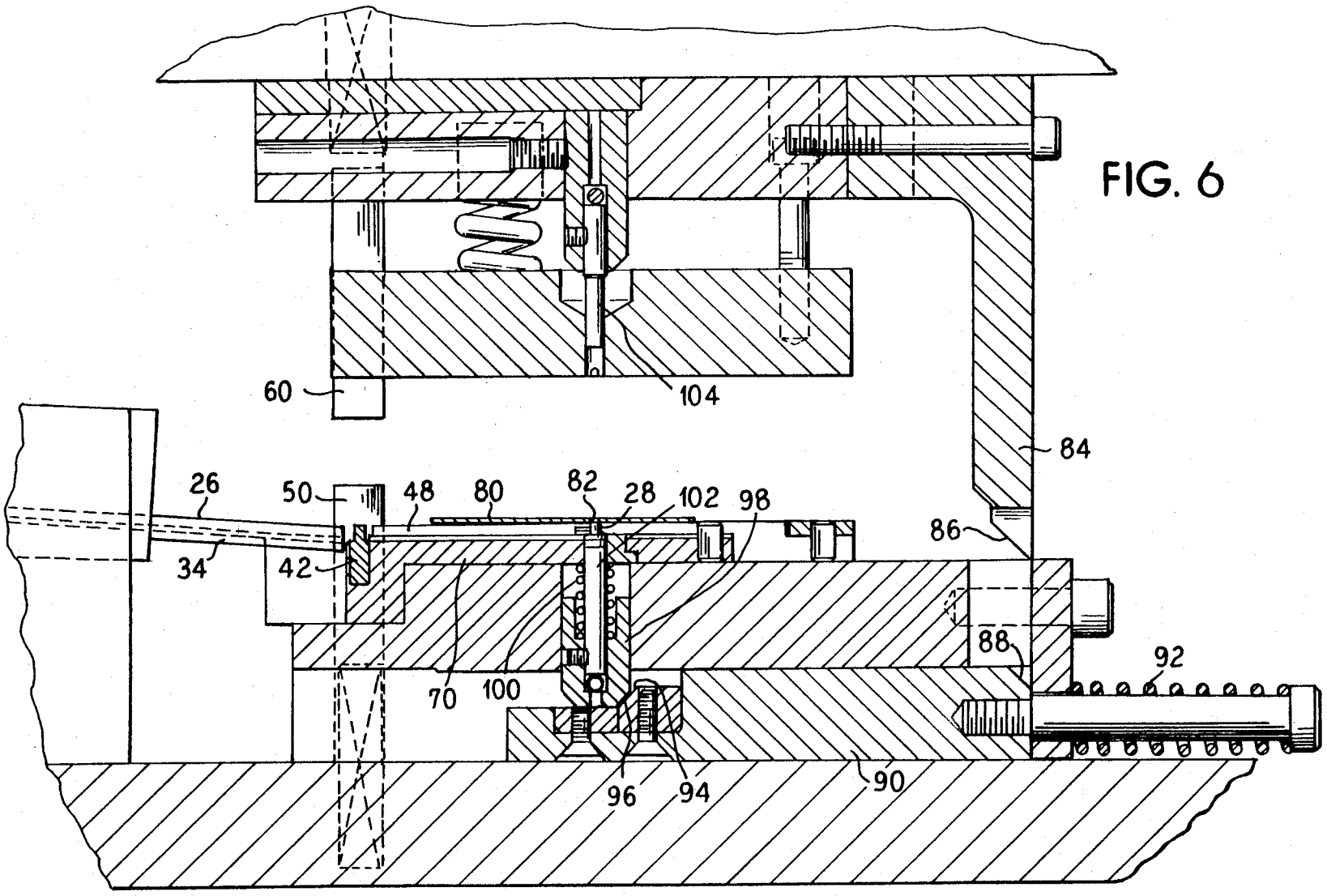
FIG. 6 is a side sectional view taken generally along the lines VI—VI of FIG. 2 with the ram in an elevated position.

A compressed air nozzle 72 (FIG. 3) is positioned to direct a high force air stream down along the gap 66 to move the single contact 28 into engagement with gripper jaws 74, 76. This occurs while the ram returns to an upper position. The jaws 74, 76 are normally biased inward by springs 78, 79 to hold the contact 28 in place. A piece of material 80 to which the contact 28 is to be applied is positioned over the contact position such that an aperture 82 in the material is positioned directly over the contact 28. The ram again descends and as it does (as shown in FIG. 6) an arm 84 having a lower bevelled edge 86 engages a bevelled edge 88 of a slide member 90. The engagement of the bevelled surfaces causes the slide member 90 to move to the left against the bias of spring 92. The slide member 90 has a second bevelled edge 94 which is in engagement with a bevelled edge 96 of an anvil carrier 98. The anvil carrier 98 is normally biased downwardly by a spring 100, but as the bevelled surfaces 94, 96 move relative to one another, the anvil carrier 98 is urged upwardly against the bias of spring 100. An anvil member 102 is therefore caused to move upwardly and engage the contact 28 and press it upwardly through aperture 82. The gripper jaws 74, 76 which normally hold the contact 28 in place have a beveled lower surface (FIG. 7) and thus when the contact is pushed upwardly by the anvil member 102, the jaws 74, 76 separate against the bias of springs 78, 79 to release the contact. When the ram reaches the lowest part of its stroke, a ram pin 104 will be brought into engagement with the exposed portion of the contact shank 30 to peen the exposed end and thereby cause a permanent joining of the contact 28 with the material sheet 80.

The ram then again moves upwardly causing the anvil member to return to its lower position and the sheet of material 80 is moved to the next work station and a new sheet of material or a new portion of the sheet 80 is slid into place to receive the next contact member.

Thus, in view of the foregoing, it is described how a rivet-like contact is attached to a sheet when the contact is fed from beneath the sheet in a head-down position.

Figure 8:
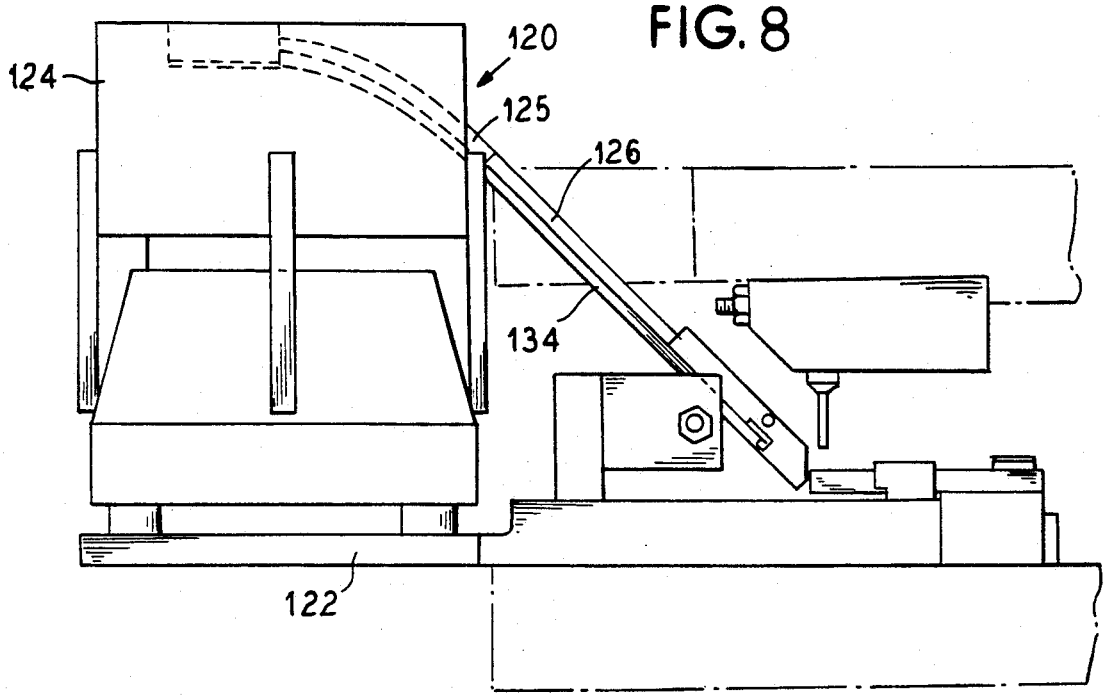
FIG. 8 is a side elevational view of an alternate embodiment of the feed installation station.

The present invention also contemplates the reverse situation when a rivet-like contact is automatically dispensed to be attached to a sheet, but this time when the feeding occurs from above the sheet with the rivet-like contact in a head-up position. Such an alternate arrangement is shown in FIGS. 8-15. In FIG. 8 there is a side elevational view of a modular contact feed and installation station generally at 120 which is composed of a number of individual component parts mounted in a cooperating relationship. A mounting plate 122 is provided as a base member for receiving all of the various components. A feeding mechanism 124, which in this embodiment is a vibratory feeder, is mounted to the mounting plate 122 to direct a series of insertion pieces from a reservoir area internal of the vibratory feeder along a ramped path 125.

In this embodiment, the insertion pieces are rivet-like contacts 128, the contact having a shaft portion 130 and an enlarged head portion 132. The ramped path 125 leads to a guide 126 which comprises a base member 134 upon which the insertion pieces slide in a head-up fashion, and a pair of guide plates 136 (FIG. 9) which are separated to provide a gap 138 therebetween which is slightly larger than a diameter of the shafts 130 of the contacts 128. Thus, the contacts will be permitted to slide along the base member 134 but will be held in a single file line by means of the guide plates 136 which also prevent the contacts from tipping over. The guide 126 is angled downwardly so that the insertion pieces will continue to move along the guide under the influence of gravity.

Figure 9:
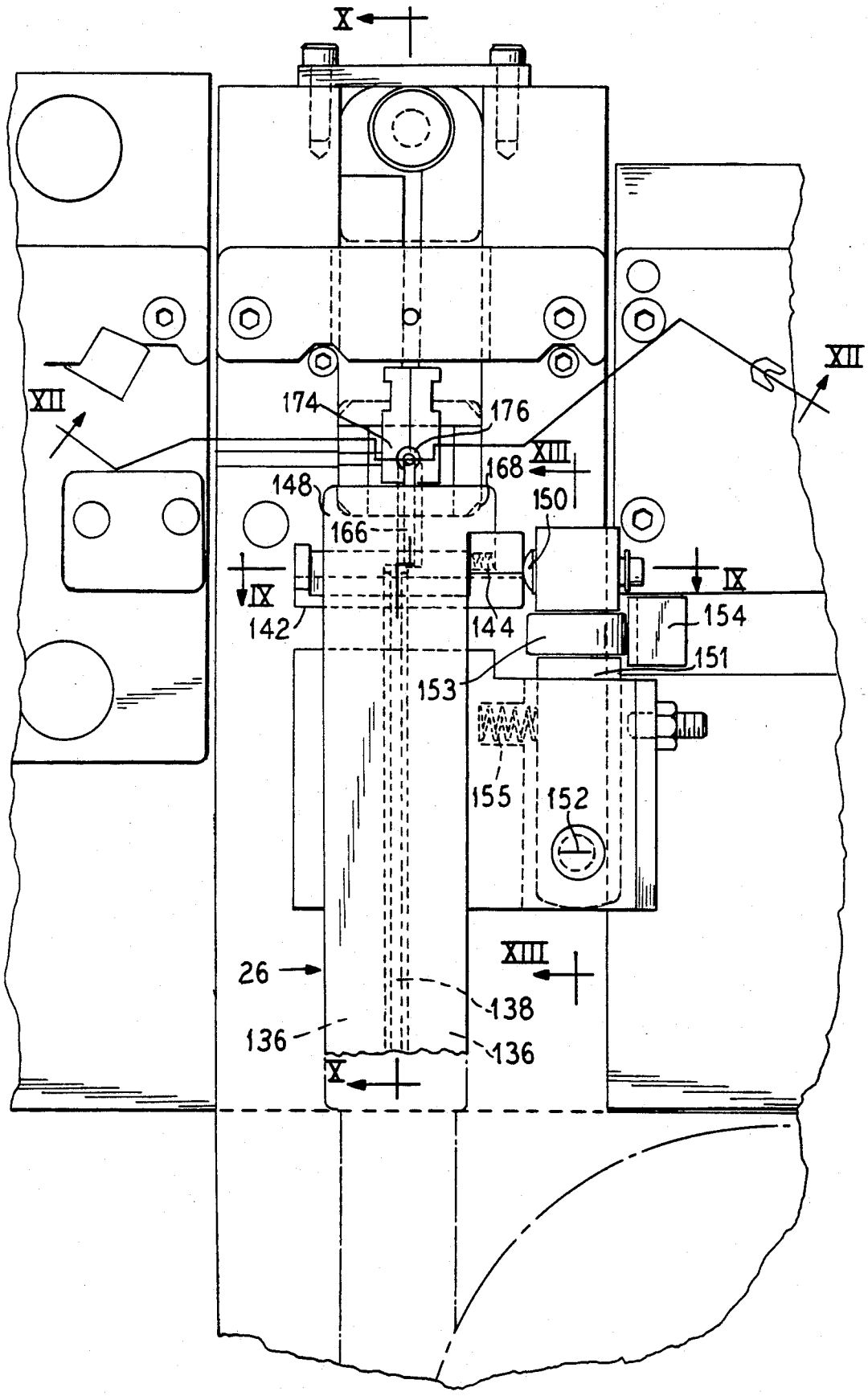
FIG. 9 is an enlarged partial plan view of the feed station of FIG. 8.
Figure 14:
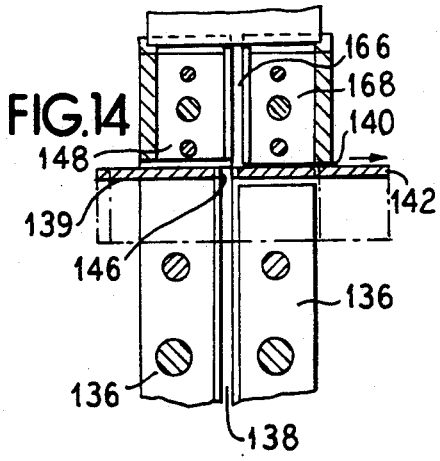
FIG. 14 is a section view generally taken along the line XIV—XIV of FIG. 10.

At an end 139 of the guide plates 136 there is a transverse passage 140 and a block 142 is positioned in the transverse passage and is biased by a spring 144 towards the right as seen in FIG. 9 and FIG. 14. An aperture 146 is formed in the block 142 which is sized to receive a single insertion piece 128.

Figure 15:
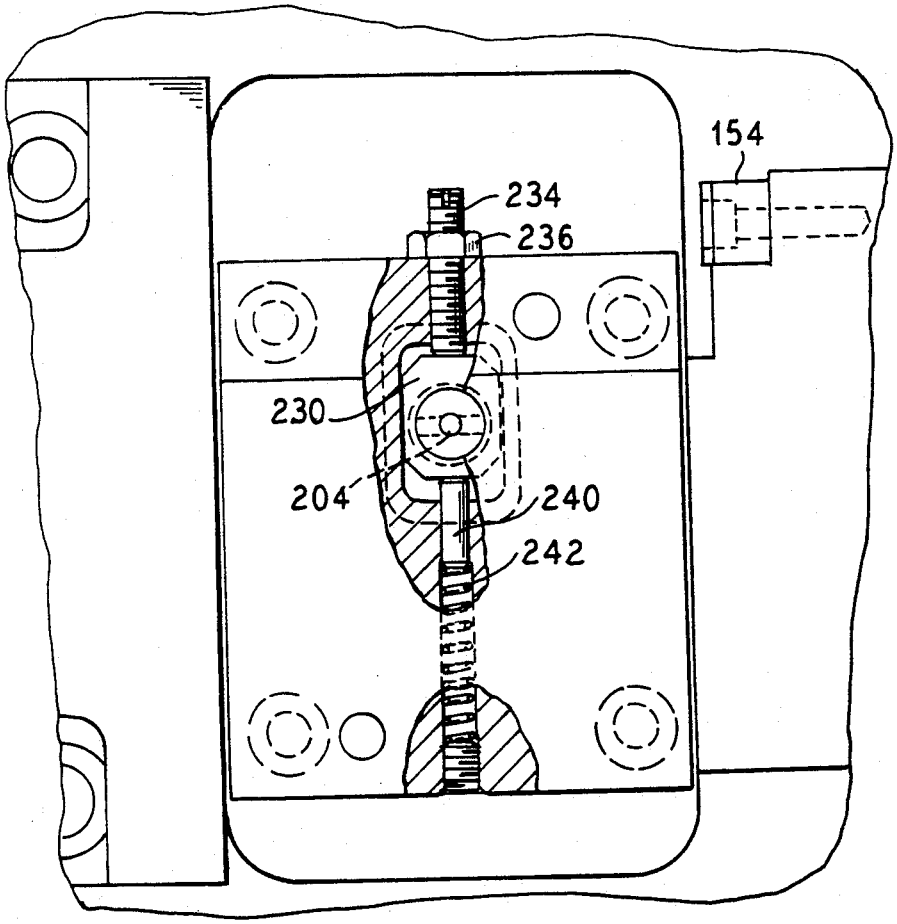
FIG. 15 is a section view generally taken along the line XV—XV of FIG. 10.

Although the aperture 146 extends all the way through the block 142, a track plate 148 acts as a stop preventing further motion of the insertion piece 128. The shuttle block 142 is engaged at an end by a spring loaded plunger 150 which is carried on the end of a pivotable actuation arm 151 (FIGS. 9 and 15). The arm 151 is pivotally mounted on a vertical pin 152 with the plunger 150 mounted on a free end of the arm. A roller 153 is carried on the arm in a freely rotatable manner. A depending finger 154 (FIGS. 11 and 9) mounted to move in direct response to the ram is engageable with the roller 153, such that as the ram descends, the finger 154 will move downwardly to engage the roller 153 causing the arm 151 to pivot about pin 152 so that the plunger 150 will push the shuttle block 142 to the left to pick up an insertion piece. When the ram subsequently moves upwardly, a spring 155 causes the arm 151 to pivot back to the right and allows the shuttle block 142 to move back to the right under the influence of spring 144.

The insertion piece 128 is then in line with a gap 166 between a first track plate 148 and a second track plate 168. These plates are also angled downwardly so as to urge the insertion piece 128 downwardly along the track under the influence of gravity.

The insertion piece continues to slide down through the gap 166 until it drops into a slotted funnel member 174 having an enlarged bevelled opening 176 leading to a central vertical passage 178. The insertion member 128 then drops down through the passage 178 which is positioned directly over an aperture 182 in a piece of material 180 to which the insertion member 128 is to be applied. The ram again descends and as it does a ram pin 204 will be inserted through the passage 178 and will be brought into contact with the head of the insertion piece 128. An anvil member 202 is positioned below the insertion piece and an anvil support block 206 is supported by one or more springs 208 so that the support block can move downwardly relative to the anvil pin 202. The anvil pin will be continuously supported against the insertion piece 128 while the support block 206 moves away, thereby allowing the insertion piece to be deformed to cause a permanent joining of the insertion piece 128 with the material sheet 180.

Figure 10:
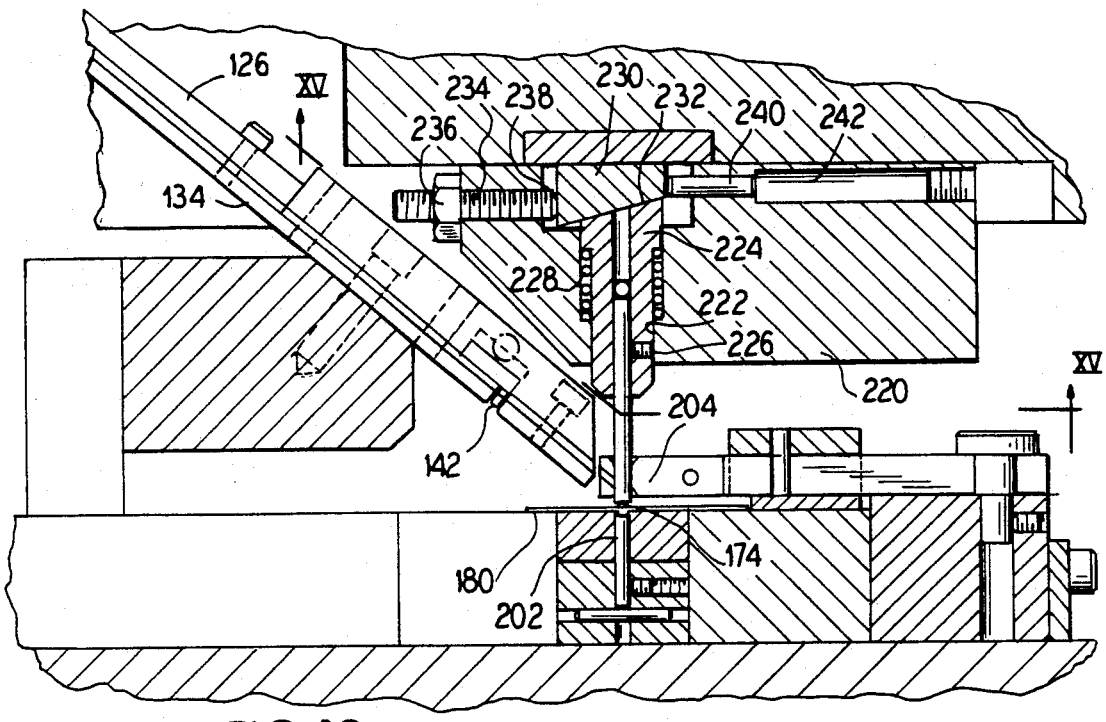
FIG. 10 is an enlarged side section view of the feed installation apparatus taken generally along the line X—X of FIG. 9.
Figure 11:
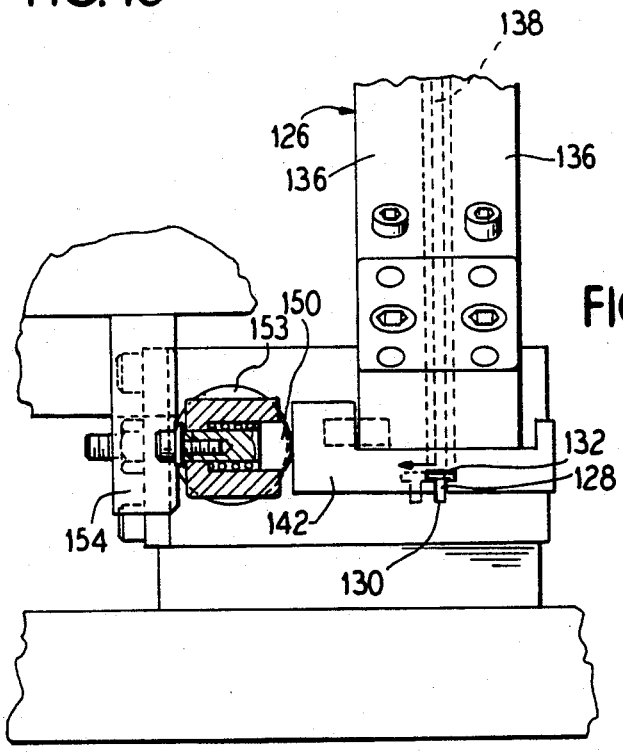
FIG. 11 is a partial sectional view taken generally along the line XI—XI of FIG. 9.
Figure 12:
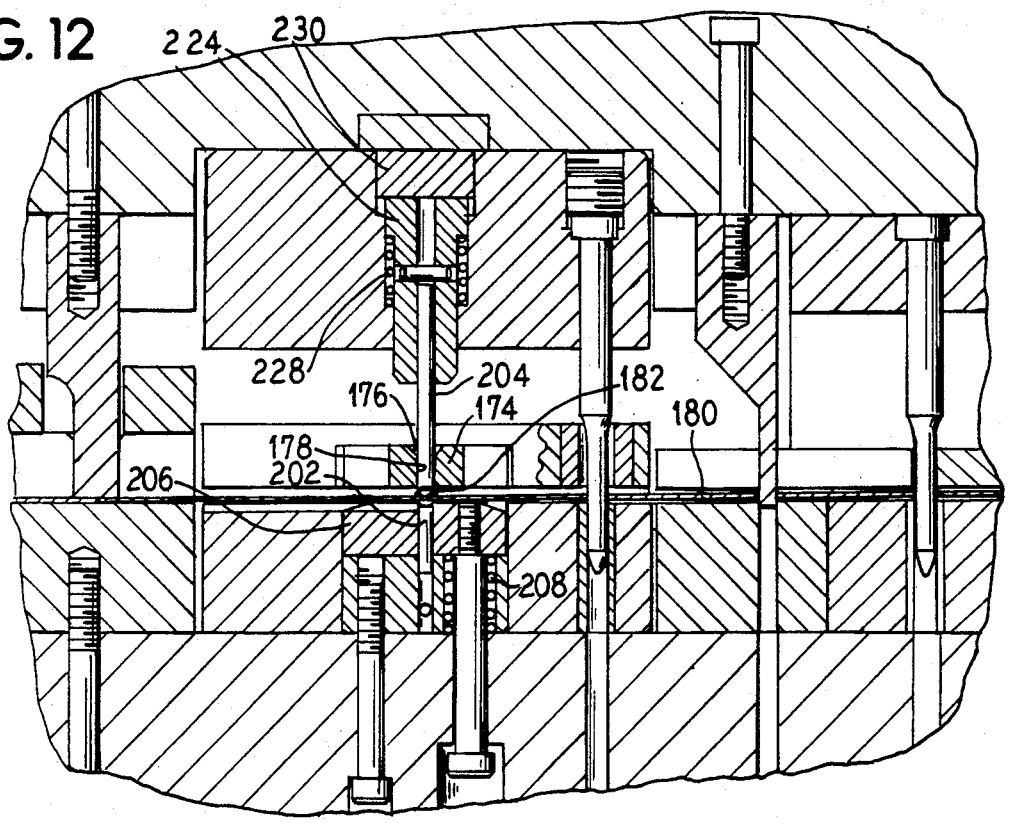
FIG. 12 is a section view taken generally along the line XII—XII of FIG. 9.
Figure 13:
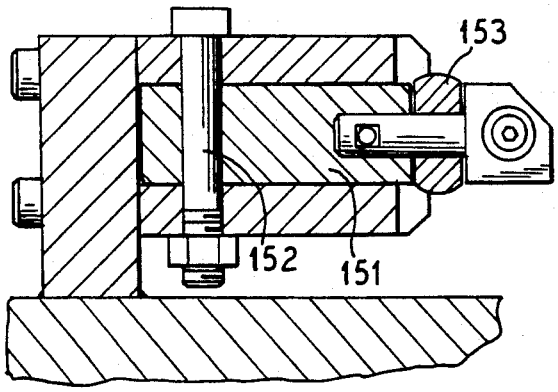
FIG. 13 is a section view taken generally along the line XIII—XIII of FIG. 9.

The position of ram pin 204, that is the extent to which it will descend into contact with the insertion piece 128 can be precisely adjusted as best seen in FIGS. 10 and 15. The punch pin 204 is carried in a block member 220 and is vertically movable in a passage 222 in the block 220. The punch pin 204 is secured within a carrier 224 by means of a set screw 226. The carrier 224 is resiliently mounted in the passage 222 and is normally biased upwardly by a spring 228. A wedge block 230 is positioned above the carrier 224 and engages a slopped upper surface 232 of the carrier. The wedge block 230 can be moved laterally by means of a screw 234 which is retained in position by a nut 236. The screw has an end 238 which presses against an end of the wedge 230. An opposite side of the wedge 230 engages a pin 240 which is biased against the wedge 230 by a spring 242. If it is desired that the punch pin 204 be moved downwardly to a greater extent during the punching operation, then the screw 234 is rotated to extend farther into the block 220 to press the wedge 230 more against the pin 240 to cause the carrier 224 to move downwardly against bias of spring 228. Conversely, to allow the punch pin 204 to not move downwardly as far, the screw 234 is backed out of block 220 allowing wedge 230 to be pushed toward screw 234 by the pin 240 biased by spring 242. This permits the carrier 224 to move upwardly under the bias of spring 228. In this fashion the precise amount of compressing force may be applied by the punch pin 204 against the insertion member 128 to cause deformation of the insertion piece upon its engagement with anvil member 202.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A modular punch press station as a single station in a progressive die of a punch press having a vertically movable ram, said station useful for inserting a headed contact into an aperture in a single carrier piece undergoing multiple operations in said punch press, comprising:

a mounting plate for attaching to said punch press at a single stationer in said progressive die;

a supply reservoir mounted on said mounting plate for receiving a plurality of said contacts;

a guide for carrying said contacts, mounted on said mounting plate;

a means for feeding said contacts from said supply reservoir to said guide, in a single file fashion;

a shuttle mechanism for receiving a single contact from said guide and for delivering said single contact to a track;

means for moving said contact along said track towards an insertion station;

said insertion station comprising means for positioning said contact below said ram in a vertical orientation in said aperture in said carrier piece;

anvil means positioned in line below said ram and carried on said mounting plate, for engaging and supporting a lower end of said contact when said ram descends into engagement with a top end of said contact;

whereby, said contact will be deformed between said ram and said anvil while positioned in said aperture in said carrier piece so as to be fixed to said single carrier piece.

2. A modular punch press station according to claim 1, wherein said mounting plate supports said supply means, insertion station, means for feeding, shuttle mechanism and said anvil means.

3. A modular punch press station according to claim 1, wherein said supply reservoir comprises a vibratory feeder mechanism.

4. A modular punch press station according to claim 1, wherein said means for feeding comprises a track with a groove therein in which said contacts slide in single file fashion.

5. A modular punch press station according to claim 1, wherein said insertion station comprises a funnel shaped member for directing said contact into said aperture in said carrier piece.

6. A modular punch press station according to claim 1, wherein said insertion station comprises a pair of opposed jaw members for receiving and grasping said contact.

7. A modular punch press station according to claim 1 including means for moving said anvil means upwardly into engagement with said contact upon descent of said ram.

8. A modular punch press station according to claim 1, wherein said means for feeding and said insertion station are arranged to present said contact below said ram and to insert it in said aperture in said carrier piece from above said carrier piece.

9. A modular punch press station for use with a punch press having a vertically movable ram, said station useful for inserting a rivet-like contact into an aperture in a carrier piece, comprising:

a mounting plate;

a supply reservoir mounted on said mounting plate for receiving a plurality of said contacts;

a guide for carrying said contacts, mounted on said mounting plate;

a means for feeding said contacts from said supply reservoir to said quide, in a single file fashion;

a shuttle mechanism for receiving a single contact from said guide and for delivering said single contact to a track;

means for moving said contact along said track towards an insertion station;

said insertion station comprising means for positioning said contact below said ram in a vertical orientation in said aperture in said carrier piece;

anvil means positioned in line below said ram and carried on said mounting plate, for engaging and supporting a lower end of said contact when said ram descends into engagement with a top end of said contact;

whereby, said contact will be deformed between said ram and said anvil while positioned in said aperture in said carrier piece so as to be fixed to said carrier piece, wherein said means for feeding and said insertion station are arranged to present said contact below said ram and to insert it in said aperture and said carrier piece from below said carrier piece.

10. A modular punch press station for use with a punch press having a vertically movable ram, said station useful for inserting a rivet-like contact into an aperture in a carrier piece, comprising:

a mounting plate:

a supply reservoir mounted on said mounting plate for receiving a plurality of said contacts:

a guide for carrying said contacts, mounted on said mounted plate;

a means for feeding said contacts from said supply reservoir to said guide, in a single file fashion;

a shuttle mechanism for receiving a single contact from said guide and for delivering said single contact to a track;

means for moving said contact along said track towards an insertion station;

said insertion station comprising means for positioning said contact below said ram in a vertical orientation in said aperture in said carrier piece;

anvil means positioned in line below said ram and carried on said mounting plate, for engaging and supporting a lower end of said contact when said ram descends into engagement with a top end of said contact;

whereby, said contact will be deformed between said ram and said anvil while positioned in said aperture in said carrier piece so as to be fixed to said carrier piece, wherein said anvil means comprises an anvil member and an anvil support member and wherein said anvil support member is movable relative to said anvil member upon descent of said ram such that said anvil member will be moved into an exposed position to engage and support said lower end of said contact.

11. A modular punch press station as a single station in a progressive die of a punch press having a vertically movable ram, said station useful for inserting a headed contact into an aperture in a single carrier piece undergoing multiple operations in said punch press, comprising:

a mounting member for attaching to said punch press at a single station in said progressive die;

supply means secured on said member for receiving a plurality of said contacts;

an insertion station on said mounting member comprising means for positioning a single contact below ram in a vertical orientation in said aperture in said carrier piece;

means for feeding said contacts from said supply means to said insertion station, such that only a single contact is presented to said insertion station at a time;

anvil means positioned in line below said ram and carried on said mounting member, for engaging and supporting a lower end of said contact when said ram descends into engagement with a top end of said contact;

whereby, said contact will be deformed between said ram and said anvil while positioned in said aperture in said carrier piece to fix said contact to said carrier piece.

12. A modular punch press station according to claim 11, wherein said mounting member comprises a plate supporting said supply means, insertion station, means for feeding and anvil means.

13. A modular punch press station according to claim 11, wherein said supply means comprises a vibratory feeder mechanism.

14. A modular punch press station according to claim 11, wherein said means for feeding comprises a shuttle mechanism capable of segregating a single contact from said supply means and presenting it to said insertion station.

15. A modular punch press station according to claim 11, wherein said insertion station comprises a funnel shaped member for directing said contact into said aperture in said carrier piece.

16. A modular punch press station according to claim 11, wherein said insertion station comprises a pair of opposed jaw members for receiving and grasping said contact.

17. A modular punch press station according to claim 11 including means for moving said anvil means upwardly into engagement with said contact upon descent of said ram.

18. A modular punch press station according to claim 11, wherein said means for feeding and said insertion station are arranged to present said contact below said ram and to insert it in said aperture in said carrier piece from above said carrier piece.

19. A modular punch press station for use with a punch press having a vertically movable ram, said station useful for inserting a rivet-like contact into an aperture in a carrier piece, comprising:

a mounting member;

supply means secured on said mounting member for receiving a plurality of said contacts;

an insertion station on said mounting member comprising means for positioning a single contact below said ram in a vertical orientation in said aperture in said carrier piece;

means for feeding said contacts from said supply means to said insertion station, such that only a single contact is presented to said insertion station at a time;

anvil means positioned in line below said ram and carried on said mounting member, for engaging and supporting a lower end of said contact when said ram descends into engagement with a top end of said contact;

whereby, said contact will be deformed between said ram and said anvil while positioned in said aperture in said carrier piece to fix said contact to said carrier piece, wherein said means for feeding and said insertion station are arranged to present said contact below said ram and to insert it in said aperture in said carrier piece from below said carrier piece.

20. A modular punch press station for use with a punch press having a vertically movable ram, said station useful for inserting a rivet-like contact into an aperture in a carrier piece, comprising:

a mounting member;

supply means secured on said mounting member for receiving a plurality of said contacts;

an insertion on said mounting member comprising means for positioning a single contact below said ram in a vertical orientation in said aperture in said carrier piece;

means for feeding said contacts from said supply means to said insertion station, such that only a single contact is presented to said insertion station at a time;

anvil means positioned in line below said ram and carried on said mounting member, for engaging and supporting a lower end of said contact when said ram descends into engagement with a top end of said contact;

whereby, said contact will be deformed between said ram and said anvil while positioned in said aperture in said carrier piece to fix said contact to said carrier piece, wherein said anvil means comprises an anvil member and an anvil support member and wherein said anvil support member is movable relative to said anvil member upon descent of said ram such that said anvil member will be moved into an exposed position to engage and support said lower end of said contact.

* * * * *